United States Patent [19]

Roussel et al.

[11] Patent Number: 4,911,825

[45] Date of Patent: Mar. 27, 1990

[54] PROCESS FOR ELIMINATION OF MERCURY AND POSSIBLY ARSENIC IN HYDROCARBONS

[75] Inventors: Michel Roussel, Antony; Philippe Courty, Houilles; Jean-Paul Boitiaux, Poissy; Jean Cosyns, Maule, all of France

[73] Assignee: Institut Francais du Petrole, Rueil-Malmaison, France

[21] Appl. No.: 321,706

[22] Filed: Mar. 10, 1989

[30] Foreign Application Priority Data

Mar. 10, 1988 [FR] France ..... 88 03258

[51] Int. Cl.[4] ..... C10G 17/00

[52] U.S. Cl. ..... 208/251 R; 423/210; 585/822; 585/823; 585/843; 585/845; 585/850

[58] Field of Search ..... 423/210; 208/251 R, 208/251 H; 585/822, 823, 845, 850, 843; 55/72, 74–76

[56] References Cited

U.S. PATENT DOCUMENTS

| | | | |
|---|---|---|---|
| 3,043,574 | 6/1963 | Bertolacini et al. | 208/251 R |
| 3,069,350 | 12/1962 | Ramella | 208/251 R |
| 4,094,777 | 6/1978 | Sugier et al. | 210/670 |
| 4,101,631 | 7/1978 | Ambrosin et al. | 423/210 |
| 4,462,896 | 7/1984 | Kilagawa et al. | 208/231 R |
| 4,532,115 | 7/1985 | Nishino et al. | 423/210 |
| 4,593,148 | 6/1986 | Johnson t al. | 423/210 |
| 4,605,812 | 8/1986 | Nowack et al. | 423/210 |
| 4,708,853 | 11/1987 | Matviya et al. | 423/210 |
| 4,709,118 | 11/1987 | Yan | 208/231 R |
| 4,719,006 | 1/1988 | Goyal | 208/251 R |
| 4,743,435 | 5/1988 | Kitahara et al. | 423/210 |
| 4,814,152 | 3/1989 | Yan | 423/210 |

FOREIGN PATENT DOCUMENTS

| | | |
|---|---|---|
| 2644721 | 4/1978 | Fed. Rep. of Germany . |
| 2726490 | 12/1978 | Fed. Rep. of Germany . |

*Primary Examiner*—Helane Myers

*Attorney, Agent, or Firm*—Millen, White & Zelano

[57] ABSTRACT

Process for elimination of mercury in hydrocarbon charges wherein said charge is contacted, under hydrogen, with a catalyst containing at least one metal from the group consisting of nickel, cobalt, iron and palladium followed by—or mixed with—a capture mass containing sulfur or a metal sulfide.

17 Claims, No Drawings

PROCESS FOR ELIMINATION OF MERCURY AND POSSIBLY ARSENIC IN HYDROCARBONS

BACKGROUND OF THE INVENTION

It is known that liquid condensate by-products of gas production (natural gas, associated gases) and crude penetration can contain numerous metallic compounds in trace amounts, generally present in the form of organometallic complexes in which the metal forms bonds with one or more carbon atoms of the organometallic radical.

These metallic compounds are poisons of catalysts used in petroleum transformation processes. In particular, they poison hydrotreating and hydrogenation catalysts by being progessively deposited on the active surface. Metallic compounds are particularly found in heavy cuts from the distillation of tanker crude (nickel, vanadium, arsenic, mercury) or in condensates of natural gas (mercury, arsenic).

Thermal or catalytic cracking treatment of the hydrocarbon cuts metioned hereinabove, for example, their steam cracking for conversion into lighter hydrocarbon cuts, allows elimination of certain metals (for example, nickel, vanadium . . . ). On the other hand, certain other metals (for example, mercury, arsenic . . . ) likely to form volatile compounds and/or being volatile in the elemental state (mercury) are at least partly found in lighter cuts and can thus poison catalysts of subsequent transformation processes. Mercury also presents the risk of provoking corrosion by forming amalgams, for example with aluminum-base alloys, particularly in the parts of the process carried out at temperatures low enough to provoke condensation of liquid mercury (cryogenic fractionation, exchangers).

Processes for elimination of mercury or arsenic in gas phase hydrocarbons are already known and operate in particular in the presence of solid masses which can be called: adsorption, capture, trapping, extraction, or metal transfer masses.

Concerning masses for demercurization, U.S. Pat. No. 3194629 describes masses consisting of sulfur or even iodide deposited on active carbon.

U.S. Pat. No. 4094777 of the applicant describes other masses comprising copper at least partly in the form of a sulfide and a mineral support. These masses can also contain silver.

French application 87-07442 of the applicant describes a specific method for preparation of said masses.

French patent 2534826 describes other masses consisting of elemental sulfur and a mineral support.

Concerning dearsenification:

German patent 2149993 recommends using group VIII metals (nickel, platinum, palladium).

U.S. Pat. No. 4069140 describes using various absorbent masses. Supported iron oxide is described. Use of lead oxide is described in U.S. Pat. No. 3782076 and use of copper oxide in U.S. Pat. No. 3812653.

Thus, although certain products described in earlier works perform well for demercurization or even for dearsenification of gases (hydrogen for example) or gaseous mixtures (natural gas for example), and in particular when the natural gas contains a large quantity of hydrocarbons including three or more carbon atoms, the tests carried out by the applicant show that the same products are revealed to be fairly inefficient once the charges contain compounds other than elemental metals, for example, for arsenic, arsines comprising hydrocarbon chains containing two or more carbon atoms or, for mercury, dimethylmercuride and other mercury compounds comprising hydrocarbon chains including two or more carbon atoms, and possibly other non metallic elements (sulfur, nitrogen . . . ).

SUMMARY OF THE INVENTION

The object of the present invention is a process for elimination of mercury contained in a hydrocarbon charge which remedies the flaws of earlier processes. According to this process, a mixture of the charge with hydrogen is contacted with a catalyst containing at least one metal from the group consisting of iron, cobalt, nickel and palladium followed by —or mixed with—a capture mass including sulfur or a metal sulfide.

When the charge also includes arsenic, the latter is also eliminated. A charge at least partly in the liquid phase is preferably used.

In the present invention, we also observed that in order to maintain a constant concentration of total sulfur (elemental sulfur and possibly a sulfur sulfide) in the capture mass, it may be advantageous to simultaneously introduce with the charge:

sulfur in the form of hydrogen sulfide ($H_2S$) and/or sulfur in the form of an organic polysulfide (for example, a dialkyl polysulfide).

Although sulfur can be introduced with the charge (organic polysulfide) and/or with the hydrogen sulfide (($H_2S$) above the catalyst, it is more preferred to introduce it between the reactor containing the catalyst and the reactor containing the capture mass in order to limit the sulfiding level to the equilibrium of said catalyst.

As a function of the operating conditions and, in particular, of the partial pressure of hydrogen and/or of water (if water is present), the proportion of sulfur introduced can be adjusted, as known to those skilled in the art, to control the equilibria of desulfiding of the capture mass and to maintain a constant sulfur concentration in the latter, as mentioned earlier, in relation to the equilibria:

$$CuS + H_2O \rightleftarrows CuO + H_2S \quad Kp = \frac{p \cdot H_2S}{P \cdot H_2O}$$

$$CuS + H_2 \rightleftarrows Cu + H_2S \quad Kp = \frac{p \cdot H_2S}{P \cdot H_2}$$

The sulfur compound is preferably introduced between the reactor containing the catalyst and the reactor containing the capture mass.

Finally, it has surprisingly been discovered that in the presence of high arsenic concentrations or in the presence of high "liquid" hourly volumetric rates involving imperfect capture of arsenic (for example, less than 90%) on the catalyst, the mass for capture of mercury also functions perfectly satisfactorily for capture of arsenic.

The catalyst entering into the compositon of the set which is the object of the present invention consists of at least one metal M chosen from the group consisting of iron, nickel, cobalt and palladium, used as such or preferably deposited on a support. At least 50% of the totality of the metal M should be in reduced form.

The catalyst support can be chosen from the group consisting of alumina, silica-aluminas, silica, zeolites, active carbon, clays and alumina cements. Nickel or a combination of nickel with palladium are preferably used.

The proportion of metal M with respect to the total weight of the catalyst is between 0.1 and 60%, more particularly between 5 and 60% and preferably between 5 and 30%. In the case of a combination with palladium, the proportion of this metal with respect to the total weight of the catalyst is between 0.01 and 10% and preferably between 0.05% and 5%.

The solid mineral dispersing agent can advantageously consist of an alumina or a calcium aluminate. It preferably has a large surface and sufficient porous volume, that is, at least 50 $m^2/g$ and at least 0.5 $cm^3/g$, respectively, for example, from 50 to 350 $m^2/g$ and from 0.5 to 1.2 $cm^3/g$.

Methods for preparation of a catalyst such as this are sufficiently known to professionals not to have to be repeated within the scope of the present invention.

Before use and if necessary, the catalyst is reduced by hydrogen or a gas containing hydrogen at a temperature between 150° and 600° C.

The capture mass entering into the composition of the set which is the object of the present invention consists of sulfur or a sulfur-containing compound deposited on a support or solid metal dispersing agent chosen, for example, from the group consisting of alumina, silica-aluminas, silica, zeolites, clays, active carbon and alumina cements.

Sulfur deposited on a support and a commercial product such as calgon HGR for example and, more generally, any product consisting of sulfur deposited on active carbon or on macroporous alumina can be used as a capture mass as described in French patent 2534826.

A compound containing sulfur and a metal P in which P is chosen from the group consisting of copper, iron, silver and, preferably, copper or a copper-silver combination is preferably used. At least 50% of the metal P is used in the form of a sulfide.

This capture mass can be prepared according to the method recommended in U.S. Pat. No. 4094777 of the applicant or by depositing copper oxide on alumina then sulfiding with an organic polysulfide such as that described in French patent application 87/07442 of the applicant.

The proportion of elemental sulfur combined or not in the capture mass is advantageously between 1 and 40% and preferably between 1 and 20% in weight.

The proportion of metal P combined or not in the form of a sulfide is preferably between 0.1 and 20% of the total weight of the capture mass.

The set consisting of the catalyst and the capture mass may be used either in two reactors or in a single reactor.

When two reactors are used, they can be arranged in sequence, the reactor containing the catalyst advantageously being placed in front of the reactor containing the capture mass.

When a single reactor is used, the catalyst and the capture mass can be arranged in two separate layers or can be mixed well.

Depending on the quantities of mercury and/or arsenic (calculated in elemental form) contained in the charge, the volume ratio of catalyst to capture mass can vary between 1:10 and 5:1.

When two separate reactors are used, the first reaction stage with the catalyst can be carried out in a temperature range from 130° to 250° C., more preferably from 130° to 220° C., and most preferably between 130° and 180° C.

The operating pressures are preferably chosen from 1 to 50 absolute bars, more preferably from 2 to 40 bars, and most preferably from 5 to 35 bars.

The capture mass works at a temperature from 0° to 175° C., more preferably between 20° and 120° C. and most preferably between 20° and 90° C., under pressures from 1 to 50 absolute bars, more preferably from 2 to 40 bars and preferentially from 5 to 35 bars.

The space velocity, calculated with respect to the capture mass, can be from 1 and 50 $h^{-1}$ and more particularly from 1 to 30 $h^{-1}$ (liquid-volumes per mass volume and per hour).

The hydrogen flow rate through the catalyst, is for example between 1 and 500 volumes (under normal gas conditions) per volume of catalyst per hour.

When a single reactor is used, it is important to adopt a temperature range preferably between 130° and 175° C. and more preferably between 130° and 150° C.

The charges to which the invention particularly applies contain from $10^{-3}$ to 1 milligram of mercury per kilogram of charge and possibly from $10^{-2}$ to 10 milligrams of arsenic per kilogram of charge.

EXAMPLE 1 (comparative test)

5 kilograms of a macroporous alumina support (prepared by steam autoclaving transition alumina) in the form of beads 2–4 mm in diameter, presenting a specific surface of 160 $m^2/g$ and a total porous volume of 1.05 $cm^3/g$—macroporous volume (pores of a diameter greater than 0.1 $\mu m$) of 0.4 $cm^3/g$—are impregnated with 20% by weight of nickel in the form of a nitrate aqueous solution. After drying at 120° C. for 5 hours and thermal activation at 450° C. for two hours under air sweeping, 6.25 kg of beads containing 20% by weight of nickel are obtained.

50 $cm^3$ of catalyst are then loaded into a stainless steel reactor, 3 cm in diameter, in 5 equal layers separated from each other by a glass wool buffer.

The catalyst then undergoes treatment under hydrogen, under the following conditions:

Pressure: 2 bars
Hydrogen flow rate: 20 l/h
Temperature: 400° C.

The duration of treatment is 8 hours, until conversion of at least 90% of nickel oxide into metallic nickel occurs.

A heavy condensate of liquefied gas, boiling in the boiling point range from 30° to 350° C. and containing 50 ppb of mercury, is then passed over the catalyst with hydrogen in ascending flow under the following conditions:

Charge flow rate: 500 $cm^3/h$
Temperature: 180° C.
Hydrogen pressure: 30 bars
Hydrogen flow rate: 2 liters/hour.

The condensate and the hydrogen are left to pass for a period of 200 hours. The results of mercury analysis in the product at the end of 50, 100, 200 and 400 hours are listed in Table 1.

During the 400 hours of the test, the content of mercury in the product issuing from the reactor is about 50 ppb.

The test is then stopped and after drying the catalyst by nitrogen sweeping, the latter is unloaded layer by layer. The weight content in mercury of each of these layers is measured. The results are grouped together in Table 2.

It can be seen that this catalyst has very low efficiency for mercury retention.

EXAMPLE 2 (comparative test)

In this example, a capture mass consisting of copper sulfide deposited on an alumina support, similar to that described in U.S. Pat. No. 4094777 of the applicant, is prepared.

50 $cm^3$ of this mass are then loaded into a reactor identical to that described in example 1.

Arrangement of the mass in 5 separate layers as well as its total volume is identical in all respects to example 1. A heavy condensate of liquefied gas identical to that described in example 1 and containing 50 ppb of mercury is then passed over the mass in ascending flow under the following conditions:

Charge flow rate: 500 $cm^3/h$

Total pressure: 30 absolute bars

Temperature: room.

The condensate is left to pass for a period of 400 hours. The results of mercury analysis in the product at the end of 50, 100, 200 and 400 hours are listed in Table 1.

It is observed that the capture mass does not lead to total decontamination during the course of the test.

The test is then stopped and after drying the catalyst by nitrogen sweeping, the latter is unloaded layer by layer. The weight content of mercury in each of these layers is measured. The results are grouped together in Table 2.

The presence of mercury is observed on all 5 beds, indicating a certain amount of saturation of the capture mass.

EXAMPLE 3 (according to the invention)

The nickel catalyst of example 1 is loaded into a first reactor, according to the technique described in example 1.

50 $cm^3$ of the capture mass of example 2 are loaded into a second reactor, according to the technique described in example 2.

After the catalyst has been reduced according to the conditions of example 1, the two reactors are arranged in series.

The same heavy condensate of liquefied gas of example 1 containing 50 ppb of mercury is successively passed through the reactor, i.e., over the catalyst and then the capture mass is ascending flow under hydrogen.

The operating conditions are as follows:

Charge flow rate (adjusted to the capture mass): 500 $cm^3/h$

Nickel catalyst

Temperature: 180° C.

Hydrogen pressure: 30 absolute bars

Hydrogen flow rate: 2 liters/hour

Copper sulfide capture mass

Temperature: 20° C.

Hydrogen pressure: 30 absolute bars

Hydrogen flow rate: 2 liters/hour

The condensate is left to pass for a period of 400 hours. The results of mercury analysis in the product at the end of 50, 100, 200 and 400 hours are listed in Table 1 hereinafter.

It is surprisingly observed that association of a catalyst with a capture mass allows satisfactory decontamination of the condensate to be obtained.

The test is then stopped and after drying the catalyst and the capture mass by nitrogen sweeping, the latter are unloaded layer by layer.

The content of mercury in each of these layers is measured. The results concerning the capture mass are grouped together in Table 2, no trace of mercury was detected on the catalyst.

It is noted that over 90% of mercury is fixed on the first layer of capture mass i.e. 1/5 of said mass. The remaining 4/5 of mass are thus still available for mercury fixing at the end of 400 hours. Long periods of efficient functioning can thus be expected.

EXAMPLE 4 (according to the invention)

The procedure followed is the same as that in example 3 but heavy condensate of liquefied gas containing 400 ppb of mercury is used.

The efficiency of the capture mass as well as the gradient of mercury concentrations remain, all proportions kept, substantially equal to those indicated in example 3.

EXAMPLE 5 (according to the invention)

The nickel catalyst of example 1 is loaded into a reactor according to the technique described in example 1.

A capture mass comprising 13% in weight of sulfur on active carbon (Calgon HGR type) prepared according to U.S. Pat. No. 3194629 is loaded into a second reactor identical to the first one.

This capture mass is arranged in 5 separate layers according to the technique used in example 1, its total volume is equal to that of the catalyst contained in the first reactor.

After the catalyst has been reduced according to the conditions of example 1, the two reactors are placed in series under hydrogen.

The same condensate containing 50 ppb of mercury is then passed under conditions identical in all respect to those described in example 3. This is continued for 400 hours.

The results of mercury analysis in the product at the end of 50, 100, 200 and 400 hours are indicated in Table 1.

The test is stopped after 400 hours of functioning. The catalyst and capture mass are dried and unloaded according to the method described in example 3.

Weight contents in mercury of each of the capture mass layers are indicated in Table 2.

EXAMPLE 6 (according to the invention)

The procedure followed is the same as that in example 5 except that 50 $cm^3$ of catalyst containing 20% in weight of nickel and 80% by weight of calcium aluminate are used.

The results of mercury analysis in the product at the end of 50, 100, 200 and 400 hours are indicated in Table 1.

The test is stopped after 400 hours. The catalyst and capture mass are dried and unloaded according to the method described in example 3.

Weight contents of mercury in each of the capture mass layers are grouped together in Table 2.

EXAMPLE 7 (according to the invention)

The procedure followed is the same as that in example 3 except that the heavy condensate of liquefied gas is replaced by naphtha boiling in the 50° to 180° C. boiling point range, containing 5 ppm of arsenic and 50 ppb of mercury, and the quantity of nickel catalysed used is 100 $cm^3$ instead of 50 $cm^3$.

The results of mercury analysis in the product at the end of 50, 100, 200 and 400 hours are listed in Table 2.

It is observed that association of the catalyst with the capture mass allows satisfactory decontamination of arsenic and mercury in the naphtha to be obtained.

After drying and unloading the reactors according to the procedure of example 3, the weight content in arsenic and mercury in each layer is measured.

It can be seen that 90% of arsenic is fixed on the first catalyst layer and 90% of mercury is fixed on the first capture mass layer.

EXAMPLE 8 (according to the invention)

The procedure followed is the same as that in example 7 except that the charge flow rate adjusted to the capture mass is 1 l/hour (LHSV 20).

EXAMPLE 9 (according to the invention)

The procedure followed is the same as that in example 7 except that the charge flow rate adjusted to the capture mass is 250 $cm^3$/hour (LHSV 5).

Arsenic and mercury analyses give the results mentioned in Table 1.

Weight contents of arsenic and mercury on each of the catalyst and capture mass layers are indicated in Table 2.

It can be seen that rate of mercury and arsenic purification do not vary at all as the LHSV alters.

EXAMPLE 10 (according to the invention)

In this example, 100 $cm^3$ of a catalyst containing 20% by weight of nickel and 0.5% by weight of palladium are prepared on an alumina support which is loaded into a first stainless steel reactor, 3 cm in diameter, in five equal layers separated from each other by a glass wool buffer.

50 $cm^3$ of a capture mass obtained by sulfiding a precursor containing 10% by weight of copper on an alumina support with an organic polysulfide are loaded into a second reactor identical to the first one. This mass is also divided into five equal layers.

After the catalyst has been reduced according to the conditions of example 1 but at a maximum temperature of 350° C., the two reactors are placed in series under hydrogen.

A naphtha with characteristics identical to those described in example 7, containing 5 ppm of arsenic and 50 ppb of mercury is successively passed over the catalyst then the capture mass in ascending flow under hydrogen.

The operating conditions are as follows:

Charge flow rate (adjusted to the capture mass): 500 $cm^3$/h

For the catalyst:

Temperature: 100° C.

Hydrogen pressure: 30 absolute bars

Hydrogen flow rate: 2 liters/hour

For the capture mass:

Temperature: 60° C.

Hydrogen pressure: 30 absolute bars

Hydrogen flow rate: 2 liters/hour

The naphtha is left to pass for 400 hours. The results of mercury analysis in the product at the end of 50, 100, 200 and 400 hours are listed in Table 1.

After drying and unloading the reactors, the weight contents in arsenic and mercury of each layer are measured, both for the catalyst and the capture mass.

The results are given in Table 2.

It is observed that the efficiencies of mercury and arsenic capture are comparable in all respects to those of the catalyst and mass described in example 7. Furthermore, addition of palladium to the nickel in the catalyst facilitates at lower temperatures.

EXAMPLE 11 (according to the invention)

In this example, 50 $cm^3$ of a mass, consisting of a mixture of metallic nickel, copper sulfide and alumina cement, which act as a catalyst and a capture mass are prepared.

First, 100 g of finely dispersed copper sulfide are prepared by reacting basic copper carbonate with a solution of 30% by weight of ditertionoyl polysulfide (commercial product TPS 37, marketed by Elf Aquitaine). The paste obtained is dried under nitrogen at 150° C. for 16 hours then activated under water vapor at 150° C. for 5 hours. The rate of flow of vapor is 1000 volumes per volumes of dried product.

1000 g of Raney depyrophorized nickel (Procatalysis NiPS2) are prepared separately.

The two products are mixed with 5000 g of commercial calcium aluminate (Secar 80) and water. The paste obtained, extruded in 2.5 mm rings, is matured for 16 hours in a ventilated oven under a mixture of nitrogen and 10% water vapor at 80° C., then dried under nitrogen at 120° C. for 5 hours and finally activated at 400° C. under nitrogen for 2 hours.

The product obtained, consisting of extrudates, 2.1–2.3 mm in diameter and of a length less than 5 mm, contains 14.3% of CuS, 14.3% of nickel and 71.4% of calcium aluminate.

This mixed mass is then loaded into a single stainless steel reactor 3 cm in diameter and arranged in 5 equal layers separated from each other by a glass wool buffer.

A naphtha with characteristics identical to those described in example 7, containing 5 ppm of arsenic and 50 ppb of mercury, is then passed in ascending flow under hydrogen.

The operating conditions are as follows:

Charge flow rate: 500 $cm^3$/h

Temperature: 80° C.

Hydrogen pressure: 30 bars

Hydrogen flow rate: 2 liters/hour

The charge is left to pass for 400 hours. Results of the analysis of yields are given in Table 1.

After drying and unloading the reactors, the weight contents in arsenic and mercury of each layer are measured and listed in Table 2.

TABLE 1

| Example n° | Arsenic concentration in the product (ppb) | | | | Mercury concentration in the product (ppb) | | | |
|---|---|---|---|---|---|---|---|---|
| | Duration of the test (h) | | | | | | | |
| | 50 | 100 | 200 | 400 | 50 | 100 | 200 | 400 |
| 1 | | | | | 40–50 | 40–50 | 40–50 | 40–50 |
| 2 | | | | | 5 | 17.50 | 27.5 | 30 |
| 3 | | | | | 0.5 | 1.5 | 2.5 | 2.5 |
| 4 | | | | | 3.5 | 10 | 18 | 20 |
| 5 | | | | | 1 | 5 | 7 | 8 |
| 6 | | | | | 1 | 4 | 6 | 6 |

TABLE 1-continued

| Example n° | Arsenic concentration in the product (ppb) | | | | Mercury concentration in the product (ppb) | | | |
|---|---|---|---|---|---|---|---|---|
| | Duration of the test (h) | | | | | | | |
| | 50 | 100 | 200 | 400 | 50 | 100 | 200 | 400 |
| 7 | <10 | <10 | <10 | <10 | 0.5 | 1.5 | 2.5 | 2.5 |
| 8 | <10 | <10 | <10 | <10 | 0.6 | 1.6 | 2.5 | 2.5 |
| 9 | <10 | <10 | <10 | <10 | 0.4 | 1.4 | 2.5 | 2.5 |
| 10 | <10 | <10 | <10 | <10 | 1 | 2 | 2.5 | 2.5 |
| 11 | <10 | <10 | <10 | <10 | 2 | 3 | 6 | 6 |

TABLE 2

| Example n° | Arsenic concentration (% weight) on the catalyst | | | | | Mercury concentration (ppb) on the capture mass | | | | |
|---|---|---|---|---|---|---|---|---|---|---|
| | layer n° | | | | | | | | | |
| | 1 | 2 | 3 | 4 | 5 | 1 | 2 | 3 | 4 | 5 |
| 1 | | | | | | nd | nd | nd | nd | nd |
| 2 | | | | | | 120 | 110 | 90 | 50 | 40 |
| 3 | | | | | | 720 | 80 | nd | nd | nd |
| 4 | | | | | | 6200 | 700 | nd | nd | nd |
| 5 | | | | | | 1040 | 260 | nd | nd | nd |
| 6 | | | | | | 560 | 190 | nd | nd | nd |
| 7 | 5.6 | 2.5 | 0.01 | 0.01 | 0.01 | 720 | 80 | nd | nd | nd |
| 8 | 6.0 | 4.2 | 1.8 | 0.5 | 0.01 | 690 | 110 | nd | nd | nd |
| 9 | 2.8 | 0.2 | 0.01 | 0.01 | 0.01 | 200 | 100 | nd | nd | nd |
| 10 | 5.5 | 0.5 | 0.02 | nd | nd | 720 | 80 | nd | nd | nd |
| 11 | 5.5 | 3.6 | 1.1 | 0.5 | 0.01 | 720 | 240 | nd | nd | nd |

nd = not detectable → Mercury < 20 ppm
Arsenic < 1 ppm

What is claimed is:

1. A process for removal of mercury and arsenic from a hydrocarbon charge which comprises passing a mixture of hydrogen and said charge into a reaction zone and into contact in said reaction zone with both a catalyst and a capture mass, said catalyst containing at least one metal M selected from the group consisting of nickel, cobalt, iron and palladium, and said capture mass containing sulfur or a metal sulfide.

2. A process according to claim 1, conducted at a pressure from 1 to 50 absolute bars with a charge flow rate, adjusted to the capture mass, between 1 and 50 volumes (liquid) per volume of mass per hour.

3. A process according to claim 1, wherein the catalyst contains from 0.1 to 60% by weight of metal on a support selected from the group consisting of alumina, silica-aluminas, silica, zeolites, clays, active carbon and alumina cements.

4. A process according to claim 1, wherein the capture mass comprises 1 to 40% by weight of sulfur with respect to its total mass and at least one support selected from the group consisting of alumina, silica-alumina, zeolites, clays, active carbon and alumina cements.

5. A process according to claim 4, wherein the capture mass also contains 0.1 to 20% by weight of at least one metal P selected from the group consisting of copper, iron and silver, and in which the metal P is at least partly in the form of a sulfide.

6. A process according to claim 1, wherein the catalyst metal M is nickel and wherein the capture mass metal P is copper.

7. A process according to claim 1, wherein the metals M, P and the sulfur are present in the same solid, both in the catalyst and the capture mass.

8. A process according to claim 1, wherein a sulfur compound selected from the group consisting of hydrogen sulfide and at least one organic polysulfide is simultaneously introduced with the charge, thereby maintaining a concentration of total sulfur in the capture mass.

9. A process for the removal of mercury and arsenic from a hydrocarbon charge which comprises passing a mixture of hydrogen and said charge into contact with a catalyst in a first reactor, then passing the resultant mixture into contact with a capture mass in a second reactor, said catalyst in the first reactor containing at least one metal M selected from the group consisting of nickel, cobalt, iron, and palladium, and said capture mass in the second reactor sulfur or a metal sulfide.

10. A process according to claim 9, wherein the first reactor is at a temperature between 130° and 250° C. and under a hydrogen pressure of from 1 to 50 absolute bars, and the second reactor is at a temperature between 0° and 175° C. in the same pressure range, and the volume of the catalyst with respect to the volume of the capture mass is from 1-10 to 5-1.

11. A process according to claim 9, wherein the charge flow rate, adjusted to the capture mass, is between 1 and 50 volumes (liquid) per volume of mass per hour.

12. A process according to claim 9, wherein the catalyst contains from 0.1 to 60% by weight of metal on a support selected from the group consisting of alumina, silica-aluminas, silica, zeolites, clays, active carbon, and alumina cements.

13. A process according to claim 9, wherein the capture mass comprises from 1 to 40% by weight of sulfur with respect to its total mass, and at least one support selected from the group consisting of alumina, silica-aluminas, silica, zeolites, clays, active carbon, and alumina cements.

14. A process according to claim 9, wherein the capture mass also contains 0.1 to 20% by weight of at least one metal P selected from the group consisting of copper, iron and silver, and in which the metal P is at least partly in the form of a sulfide.

15. A process according to claim 14, wherein the catalyst metal M is nickel and the capture mass metal P is copper.

16. A process for the removal of mercury from a hydrocarbon charge which comprises passing a mixture of hydrogen and said charge into a reaction zone and into contact in said reaction zone with a nickel catalyst, followed by or mixed with a capture mass containing copper sulfide.

17. A process for the removal of mercury from a hydrocarbon charge which comprises passing a mixture of hydrogen and said charge into contact with a catalyst in a first reactor, then passing the resultant mixture into contact with a capture mass in a second reactor, said catalyst containing at least one metal selected from the group consisting of nickel, cobalt, iron, and palladium, and said capture mass containing sulfur or a metal sulfide, said first reactor being operated at a temperature of between 130°-250° C. and under a hydrogen pressure of from 1 to 50 absolute bars, said second reactor being operated at a temperature of between 0°-125° C. in the same pressure range, said catalyst having a volume with respect to the volume of the capture mass of from 1:10 to 5:1.

* * * * *